US005619582A

United States Patent [19]

Oltman et al.

[11] Patent Number: 5,619,582

[45] Date of Patent: Apr. 8, 1997

[54] ENHANCED CONCERT AUDIO PROCESS UTILIZING A SYNCHRONIZED HEADGEAR SYSTEM

[76] Inventors: Randy Oltman, 10A Cedar La., Highland Park, N.J. 08904; Perry L. Nusbaum, 650 4th St., NE., No. 3, Washington, D.C. 20002

[21] Appl. No.: 585,774

[22] Filed: Jan. 16, 1996

[51] Int. Cl.[6] ..... H04R 27/00

[52] U.S. Cl. ..... 381/82; 381/79

[58] Field of Search ..... 381/79, 80, 77, 381/82, 97, 83, 183

[56] References Cited

U.S. PATENT DOCUMENTS

| | | |
|---|---|---|
| 4,165,487 | 8/1979 | Corderman . |
| 4,610,024 | 9/1986 | Schulhof . |
| 4,618,987 | 10/1986 | Steinke et al. . |
| 4,829,500 | 5/1989 | Saunders . |
| 4,899,388 | 2/1990 | Mlodzikowski et al. . |
| 5,131,051 | 7/1992 | Kishinaga et al. . |
| 5,410,735 | 4/1995 | Borchardt et al. . |
| 5,432,858 | 7/1995 | Clair, Jr. et al. . |

*Primary Examiner*—Curtis Kuntz
*Assistant Examiner*—Vivian Chang
*Attorney, Agent, or Firm*—Longacre & White

[57] ABSTRACT

An audio enhancement system and method is provided wherein a wireless headphone system comprises a transmitter and a receiver including a synchronization device which utilizes electromagnetic locating signals to locate the position of the receiver with respect to the transmitter. The transmitter for this system will broadcast a frequency modulated (FM) signal on a number of separate channels in the 900 MHz band range. Each channel will carry the same audio information, however, each successive channel will have its audio signal delayed by a preset time period, e.g. 50 ms, relative to the previous channel. The headset receiver, supporting position location signals, and associated hardware will select the appropriate channel depending on the listener's distance from the main loudspeakers. These channels are laid out such that when in a large venue, and if the proper channel is chosen, the sound received electronically over the wireless channel will be approximately in phase with the sound arriving to the listener from the main loudspeakers.

12 Claims, 3 Drawing Sheets

ENHANCED CONCERT AUDIO PROCESS UTILIZING A SYNCHRONIZED HEADGEAR SYSTEM

BACKGROUND OF THE INVENTION a) Field of the Invention

The present invention generally relates to audio systems and more particularly to systems for enhancing the sound received by transient individuals located at discrete locations distanced from a primary loudspeaker system. The subject audio system permits transient individuals to roam within a predetermined area without overly detracting from the sound quality delivered to these individuals.

b) Description of Related Art

The current state of the art for sound reproduction or sound supporting equipment used in concert halls or in other indoor and outdoor spaces entails the use of one or more loudspeaker cluster locations. These locations are typically located at or near the physical location of the actual sound source or that of the virtual sound source. Unfortunately, the acoustical sound reproduction quality of such conventional systems is detrimentally effected by distortion of the frequency and time spectrum resulting from the distances travelled by the sound. Also, non-linear type distortions are introduced due to the physics of the air compression and rarifactions by which the sound propagates. Moreover, since the perceived loudness and sound pressure level decreases in proportion to the distances travelled from the sound source, in order to achieve the desired sound pressure level at remote listener positions substantially more sound pressure must be developed at the source. However, increasing sound pressure level at these discrete locations produces increased distortion.

Persons attending concerts, shows, or speaking engagements in large halls or arenas (indoor as well as outdoor) are becoming more demanding in their desires for high quality sound; they want to have the sound quality delivered to their specific location by public address systems which mimic recording studio quality or at least mimics the sound quality at the main loudspeaker's mixer board. One common approach taken by sound system designers is to utilize "delayed speaker systems" in combination with the main loudspeaker system. In particular, additional loudspeakers are provided at remote locations in order to direct quality sound reproduction to individuals who are poorly positioned to receive sound from the main loudspeaker system. These fixed remote loudspeakers typically have their input signals delayed in time with respect to signals provided to the main loudspeaker systems to synchronize their acoustic output with the sound arriving from the main loudspeaker system; this approach reduces echo and feedback which results from two sound sources which are offset in distance. However, these fixed remote loudspeakers fail to properly serve transient individuals.

In an attempt to provide an enhanced audio system, U.S. Pat. No. 5,432,858 to Clair, Jr., et al. teaches a audio system comprising a wireless transmitter and plural augmented sound reproducing systems. Each sound subsystem is a portable unit arranged to be carried by a person located at a remote position with respect to the main loudspeaker. Each sound subsystem includes a receiver for receiving a broadcast signal, and a microphone positioned on a headset to detect sound arriving from the main loudspeakers. The sound subsystem further includes circuitry which augments this broadcast signal to thereby synchronize the broadcast signal with the sound arriving from the main loudspeakers. In order to augment the broadcast signal in accordance with the teaching of this patent, the subsystem uses a delay circuitry provided in the subsystem headphone set which delays the broadcast signal received by the receiver for a predetermined period of time which generally corresponds to the time it takes for the sound arriving from the main loudspeakers to propagate through the air to the remote location of the headset.

The sound augmentation system disclosed by U.S. Pat. No. 5,432,858 takes one of three forms: a "zone" system, a "manually synchronized" system, and a "self-synchronized" system. For the "zone" system, the audience is broken into discrete zones, which encompass a known distance from the main sound source. Each listener located within a given zone receives augmented sound from a particular receiver/transducer subsystem delayed a predetermined time. Accordingly, the augmented sound and the main sound arrive at the ears of each listener within that zone in substantial synchronism. More particularly, audience members within each zone personally tune their respective receiver to the appropriate channel for their zone, to thereby listen to the sound reproduced by the associated remote transducer in substantial synchronism with the main arriving sound. However, each person attending a concert where the "zone" system of this invention is in use must be given instructions on how and why to tune his/her receiver/amplifier unit to a particular channel setting based on that individual's location. It will be understood by anyone familiar with typical concert environments, however, that such a system will be overly complicated and impractical to distribute and use. Moreover, this system overly limits the portability of the audio system because the "zone" system requires the user to manually tune his/her receiver during movement about the arena.

The second "manually synchronized" system of U.S. Pat. No. 5,432,858 is even more limiting than the "zone" system described above. The "manually synchronized" system requires the listener to manually adjust his/her time delay circuitry. With this arrangement, the entire audience is covered by a single transmitter zone, wherein the audio signal is broadcast over a single frequency by a common, single wireless transmitter to all of the receiver/transducer subsystems located throughout the concert hall. It will again be understood by anyone familiar with typical concert environments, however, that such a "manually synchronized" system will be overly complicated and impractical to both distribute and use.

The third "self-synchronized" system of U.S. Pat. No. 5,432,858 accomplishes synchronization of the broadcast signal and the sound arriving from the main loudspeakers by providing a sampling microphone on the portable transducer unit. The circuitry of the portable transducer unit automatically adjusts the time delay in response to the sound picked up by the sampling microphone. This "self-synchronized" system suffers from the drawback in that it requires overly complex, costly and bulky circuitry. Specifically, the receiver/amplifier unit requires a wireless receiver, signal dynamics processor with a gating circuit, a programmable control signal delay circuit, a signal gate, a microphone preamplifier, a summing circuit, and a signal correlation circuit. The signal correlation circuit itself comprises a correlate circuit and a controller. Of course, the sampling microphone is inherently susceptible to background ambient noise, and thus require further means to disable the microphone when not in the presence of the main arriving sound.

While the foregoing approaches to achieve sound enhancement have some aural benefits, these conventional systems nevertheless suffer from numerous drawbacks resulting from decreased sound quality being delivered to remote listeners. These systems also limit the listener to specific listening areas, thus do not satisfy the listening needs of a mobile audience. Moreover, the prior art systems result in relatively complex, unwieldy and inflexible sound reproduction systems. Thus, the resulting size, weight and cost of these prior art receivers are preclusive.

Accordingly, the need exists for an audio enhancement system which overcomes the disadvantages of the prior art.

SUMMARY OF THE INVENTION

It is generally the object of this invention to provide an audio enhancement system which overcomes the disadvantages in the prior art.

It is further the object of this invention to provide an audio enhancement system for providing a synchronized signal to transient persons located at remote distances from a main loudspeaker so that the synchronized signal provides a studio quality sound, or at least a mixer-board quality sound, in synchronization with the sound delivered by the main loudspeakers.

In accordance with these and other objects of the instant invention, an audio enhancement system and method is provided wherein a wireless headphone system comprises a transmitter and a receiver which utilize an unlicensed frequency band defined by the FCC for in-home and short-range use.

The transmitter for this system will broadcast a frequency modulated (FM) signal on a number of separate channels in the 900 MHz band range. Each channel will carry the same audio information, however, each successive channel will have its audio signal delayed by a preset time period, e.g. 50 ms, relative to the previous channel. The headset receiver, supporting position location signals, and associated hardware will select the appropriate channel depending on the listener's distance from the main loudspeakers. These channels are laid out such that when in a large venue, and if the proper channel is chosen, the sound received electronically over the wireless channel will be approximately in phase with the sound arriving to the listener from the main loudspeakers.

Listener location is determined and the appropriate transmission channel is automatically selected in a novel manner whereby dedicated pulse transmitters are strategically located in the venue. Each individual headset and associated receiver will calculate its approximate position based on the signals provided by these dedicated pulse transmitters, and will tune in to one of the channels broadcasting the FM signal in the 900 MHz band.

This system therefore provides a method and apparatus for accurately receiving a broadcast signal which provides a studio quality sound, and synchronizing this signal with the sound arriving from the main loudspeaker system. The system of the invention is simple to use, does not require manual operation by the user, and permits each individual to roam with respect to the main loudspeaker system without suffering from feedback, distortion, or out-of-synch sound reproduction.

Other advantages and benefits of the instant invention will become apparent to those of skill in the art in view of the following drawings, and the detailed description that follows.

DETAILED DESCRIPTION OF THE PREFERRED EMBODIMENT

Figure 1:
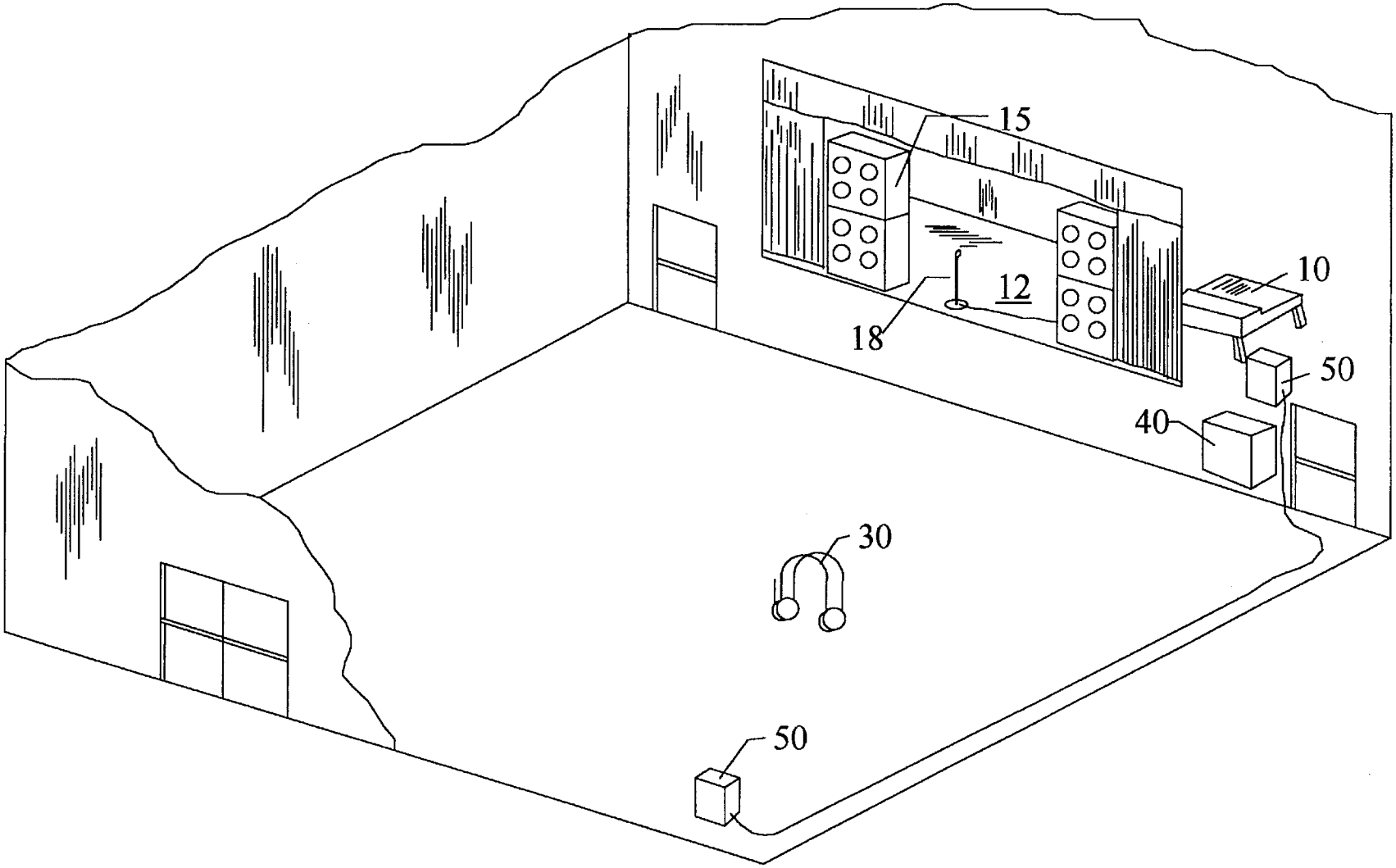
FIG. 1 is a schematic representation of the venue served by the audio system of this invention.

Referring to FIGS. 1–4, an audio enhancement system for use with conventional sound reproduction systems will now be described with reference to several preferred embodiments. It will be understood that the embodiments described herein are not intended to limit the scope of the invention, but merely provide examples of the present invention as used in several environments.

The primary sound reproductive system can be any type of system having at least one primary loudspeaker or at least one main cluster of loudspeakers 15 located at one position, e.g. a stage or podium 12. The loudspeaker system produces sound in response to an electronic input signal provided by any suitable audio source, for example microphone 18, which is processed by a main sound board or mixer board 10. While the invention is primarily envisioned for use with live public broadcast or entertainment, it should be noted that the invention is equally suited for use in simulcast or recorded broadcast, or any arena (indoor and outdoor) wherein audio enhancement may be integrated with a primary loudspeaker system. The main loudspeaker(s) 15 propagate the sound produced thereby through the air so that it may be heard by persons located at various positions about the arena.

The audio enhancement system of this invention serves to augment or enhance the sound heard by transient individuals by providing distortion-free, yet synchronized sound via personal transducer devices which are located near or carried by such persons. To ensure that the distortion-free sound enhances rather than degrades the primary sound arriving from the main loudspeakers, the system of this invention is designed so that the audio enhancement system provides a synchronized signal, i.e., the sound arrives at the listener's ear in synchronism with the sound arriving from the main loudspeakers.

As will be appreciated by those possessing skill in the art, the implementation of audio enhancement in accordance with the teaching of this invention may take various configurations. However, these embodiments are merely exemplary. Thus, other configurations may be constructed in accordance with the teachings of this invention.

Each of the embodiments of the audio enhancement basically comprises at least one transmitting subsystem and at least one remote receiver subsystem. Those subsystems will be described in detail below. In general, each receiver subsystem basically comprises a receiver compactly housed within a portable unit, and an associated portable transducer unit, i.e., a pair of headphones.

Each receiver subsystem is arranged to be located at any remote location inhabited by the listener so that it may receive electrical signals transmitted from transmitter subsystem(s). The signals broadcast by the transmitter subsystem(s) represent(s) the signals provided by the audio source to the main loudspeaker(s), and preferably comprises a signal delivered from a central mixer board. The receiver unit of the subsystem receives the broadcast signals, then converts, processes and amplifies them into signals for driving the associated transducer device, i.e. headphones, to produce a sound in synchronism with the sound arriving from the main loudspeakers.

In order to facilitate locating a receiver subsystem as near as possible to the listener, the electrical signal provided to the receiver is transmitted without wire. Thus, the system makes use of wireless transmitters in the transmitting subsystem for broadcasting the audio signals to the plural and transient remote receiving and transducing subsystems.

As previously mentioned, the audio enhancement system of this invention basically comprises at least one transmitter subsystem and at least one remote receiving subsystem. In order to synchronize the sound arriving to the receiving subsystem with the sound arriving from the main loudspeaker(s), the present invention provides a synchronizing means. The synchronizing means includes a pulse transmitting subsystem which locates the receiving subsystem and tunes the receiver subsystem to a suitable delay channel which is received by the receiving subsystem. The signal delivered through this delay channel has its audio portion delayed by a predetermined time period proportioned to compensate for the time period it takes for the primary sound delivered by the main loudspeakers to propagate through the air to the remote location of the receiver subsystem.

The receiver subsystem of this invention is designed to detect electromagnetic information to approximate a radial distance from the main sound source. More specifically, the synchronizing means of this invention delivers RF pulses to the listening area occupied by the transient listeners. These RF pulses are used to approximate the distances of each receiver subsystem from the main loudspeaker. In the preferred embodiment, the receiver subsystem compares the arrival times of various RF pulses to approximate its distance from the main loudspeaker(s). For example, two RF pulse transmitters may be located in the arena to be served by this invention; a first RF pulse transmitter located in the front portion of the arena proximate the primary sound source, and a second RF pulse transmitter located in the rear portion of the arena distal from the primary sound source. The receiver compares the arrival times of these two RF pulses to approximate the distance from the stage.

In an alternate embodiment, an RF generator creates standing waves by way of the beat frequency of two RF pulses. The beat frequency, for instance, has a wavelength of approximately 4 times the approximate depth of the venue. With this information, position determination may be made by the receiver.

For these synchronization means, the receiver uses the position location information to pick one of a plurality of channels that will be broadcast at approximately 900 MHz by the transmitter subsystem. The plurality of channels are chosen such that each successive channel is delayed by a fixed amount relative to each other. For the position location and channel determination of this invention, an X,Y position is not needed; rather, only an approximate radial distance from the front of the main loudspeaker system is needed. It should be noted that the human ear can only perceive the difference in arrival time of two sounds (in the same ear) when the sounds are more than about 25 ms apart. In view of these facts, the radial position of the receiver need only be accurate within 15–20 meters.

Many different methods of position location are possible, including the following preferred method: two dedicated pulse transmitters are positioned in a single venue, one in front and one in back. The front pulse transmitter may output a 900 MHz RF pulse with a width of 10 ns. These pulses would be repeated every 1 ms. The transmitter in the back of the venue would receive the pulse from the front pulse transmitter, and transmit its own 10 ns 900 MHz pulse; 50 ns after it receives its first pulse. Thus, each headset in the venue would receive two pulses, every 1 ms. Headsets in the front of the venue would receive their pulses 500–1000 ns apart depending on venue size, while units in the rear of the venue would receive their pulses 50 ns apart. This difference in delay is perceivable electronically, and could be used to find an approximate location of individual headset. Internal to the headset unit, the varying delay would change the voltage of the VCO in the down-converter such that the appropriate channel would be chosen.

One must consider that the system of this invention is not attempting to match electromagnetic waves, but instead matches the phase of sound pressures from the stage and through the headset. When dealing with sound pressures, the ear is much more tolerant of error than an electronic receiver is to phase errors in electromagnetic waves. Thus errors in the phase match of the two combining sounds will not easily be perceived by the user. In fact, laboratory simulations shows that if the delay difference of these two sound signals are matched to within 25 ms, then there is no perceived difference between the two waveforms by a listener.

Figure 2:
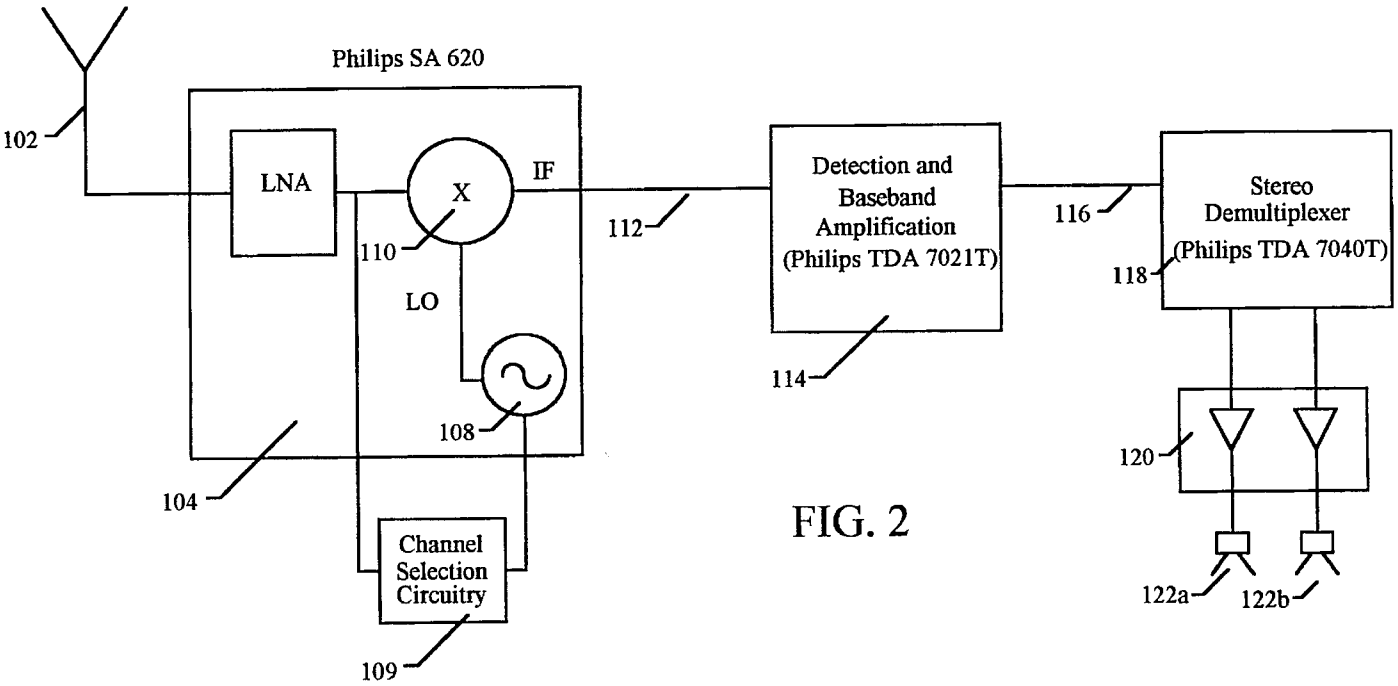
FIG. 2 is a schematic representation of the receiver and transducer unit of this invention.

The receiver operates as follows. With reference to FIG. 2, the signal is received by the antenna 102 and goes directly to a multipurpose integrated circuit 104, e.g., the Philips SA620 multipurpose IC. Such an integrated circuit contains a low noise amplifier (LNA) 106, a down converter (double balanced mixer) 108, and a voltage controlled oscillator (VCO or local oscillator, LO) 110. The low noise amplifier 106 first amplifies the radio signal delivered by the antenna 102. The signal is then down-converted by the mixer 110 using a frequency provided by the local oscillator 108. The IF 112 output of the multipurpose IC 104 will be in the frequency range of a standard broadcast FM signal (about 100 MHz, and much stronger such that local stations will not interfere with operation). Prior to being delivered to the detection and databand amplification unit 114, the IF signal 112 is processed by the channel selection circuitry 109 in the manner described below with reference to FIG. 4. Next, detection and databand amplification will be performed by a single chip FM receiver 114, e.g. Philips TDA 7021T, which "receives" the 100 MHz signal, and converts it to a multiplexed stereo signal at a second IF 116 of 70 kHz. This 70 kHz signal 116 can then be passed to a stereo demultiplexer 118, i.e. a Philips TDA7040T stereo demultiplexer, and a audio amplifier 120, i.e. a Philips TDA7050T audio amplifier, for final output to the user at left and right speakers 122*a*, 122*b*. The final amplifier 120 will be connected to a volume control (not shown) on the outside of the headset unit so that the user can set the audio power to a desired level. All of the IC's envisioned by this invention may be contained in small surface-amount packages, and draw relatively low power.

With reference to FIG. 1, the audio enhancement system of this invention will now be described. Sound is first picked up by microphones 18 for the instrument or voice. This sound is directed to the central sound board 10 where all the individual sounds are processed and mixed together. Effects and equalization happens at this point. Next the sound is sent to power amplifiers, and from there to the speaker system 15. The mixed, equalized sound is also sent to the transmitter subsystem, i.e. headgear 40, (at audio frequencies, electronically over signal cables).

Figure 3:
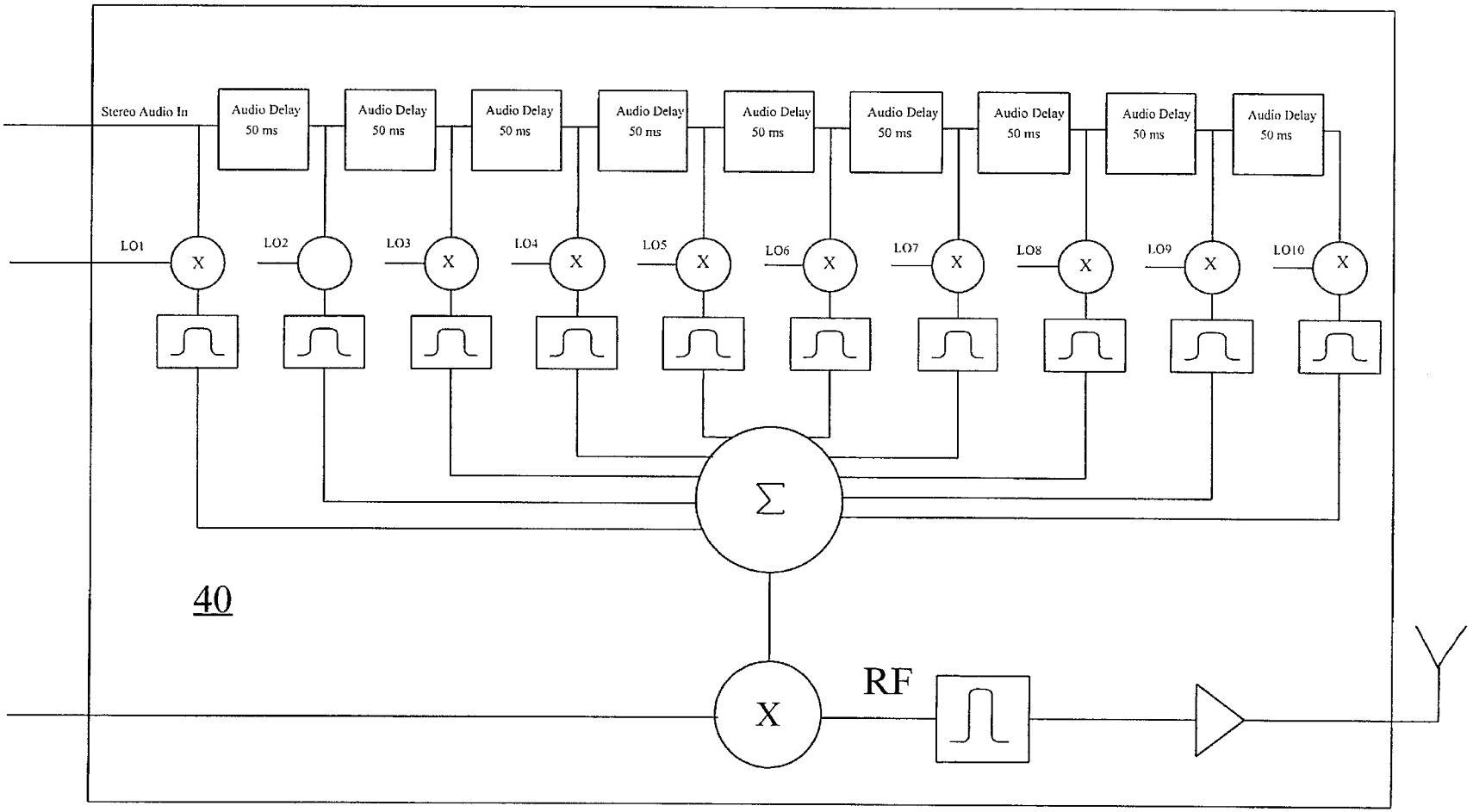
FIG. 3 illustrates an example of circuitry for channel splitting and transmission via the headgear transmitter(s).

In the headgear transmitter(s) 40, the arriving audio signal is split into 10 channels, and each channel is then delayed by a pre-established amount of time. Each of these delayed copies of the original signal is then modulated onto its own 900 MHz carrier for transmission to the headgear receiver 30. FIG. 3 illustrates an example of circuitry for channel splitting and transmission via the headgear transmitter(s) 40.

Separate to the headgear transmitter(s) 40 are two headgear RF pulse transmitters 50. The pulse timing of these two transmitters is chosen such that a receiver in the venue can receive and determine an approximate radial position based on the difference in arrival time of these pulses. The RF pulses are the lowest in frequency of the headgear generated 900 MHz signals such that in the IF section of the receiver, a simple lowpass filter can be used to reject the audio information, and allow the pulse information to pass. Based on the arrival time of the pulses, the channel selection circuitry (see FIG. 4) in the receiver sets a control voltage of the single chip receiver 114, e.g. Philips TDA7021T. This control voltage picks one of the 900 MHz RF channels that has the audio portion delayed. More specifically, the control voltage changes the IF frequency chosen within the receiver 114. With this arrangement, the chosen channel will have its audio portion delayed approximately by the same amount of time as it takes for the sound to travel from the stage speakers to the position of the receiver. Thus, the electronic sound and the sound travelling through the air will be approximately in phase, and the listener will not perceive any echoes or mismatch between the timing between the two sounds.

Figure 4:
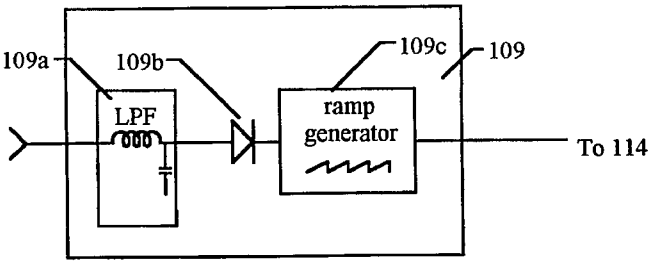
FIG. 4 illustrates the channel selection circuitry of this invention.

With reference to FIG. 4, the channel selection circuitry 109 (see FIG. 2) will now be described. The RF pulses received by the antenna have been down-converted to an IF signal by the mixer 110. Diode 109*b* detects the RF pulses hat have been down-converted to IF. Since the IF is low-pass filter at LPF 109*a*, most of the modulated signal has been rejected. The frequency plan is such that the RF pulses end up in the pass band of this filter 109*a*, while the information signal is rejected. Ramp generator 109*c* receives pulse signals from the diode 109*b*. On reception of the first pulse, the ramp generator 109*c* starts. On the reception of the second, the ramp locks at the current voltage. Thus, varying arrival times of the pulses will change the control voltage on the channel selection pin of the detection and databand amplification unit 114, e.g. Philips TDA 7021T.

An FM modulation scheme with the same modulation characteristics is preferred for this invention, among other reasons, because (1) small single chip integrated circuit FM receivers are currently available for a reasonable cost; (2) over short distances (and thus reasonable power limits), an FM system will have a relatively high signal-to-noise ratio and will be close to compact disc quality; and (3) using FM analog modulation in the 900 MHz band avoids the use of space and overly-high power consumptive microcontroller integrated circuit's and their supporting hardware.

While the description of this invention has focused on the use of ten channels, it will be understood by those having skill in the art that the number of channels may be chosen depending on the size of the particular venue to be serviced and the range of accuracy sought. Using ten channels each successively delayed by 50 ms offers a maximum delay of 500 ms. This corresponds to a maximum matched distance of 165 meters, a range of coverage deemed adequate for most venues. If the correct channel is chosen at the receiver, the maximum delay error between the electronically transmitted sound and the sound waves that travelled from the stage would be 25 ms. As mentioned above, a time difference of 25 ms is not easily perceived by the human ear.

While the instant invention has been shown and described with reference a number of preferred embodiments, it will be understood by those possessing skill in the art that various changes in form and detail may be made without departing from the spirit and scope of the present invention.

We claim:

1. An audio enhancing system for delivering an enhanced audio signal from a primary source to a plurality of discrete locations located within an arena, said audio enhancing system comprising:

an audio source means for generating a first audio signal and for converting said first audio signal to a first electromagnetic signal;

a primary signal propagating means for broadcasting said first audio signal;

a first transmitting means for transmitting said first electromagnetic signal via a wireless media;

a receiver means for receiving said first electromagnetic signal and converting said first electromagnetic signal into a second audio signal;

a second transmitting means for transmitting an electromagnetic locating signal, said electromagnetic locating signal comprising information related to a relative position of said receiver means with respect to said primary signal propagating mean;

a synchronization means for automatically delaying said first electromagnetic signal based on said electromagnetic locating signal, said receiver means deriving said second audion signal by substantially synchronizing said first audio signal with said second audio signal by said synchronization means.

2. The audio enhancing system according to claim 1, wherein said first transmitting means transmits said first electromagnetic signal on a plurality of channels.

3. The audio enhancing system according to claim 2, wherein at least two of said plurality of channels are offset in time.

4. The audio enhancing system according to claim 2, wherein each of said plurality of channels are offset in time by a predetermined amount.

5. The audio enhancing system according to claim 1, wherein said synchronization means comprises an electromagnetic locating means for determining a position of said receiver means based on said electromagnetic locating signal.

6. The audio enhancing system according to claim 2, wherein said second transmitting means comprises at least one electromagnetic pulse transmitter transmitting said electromagnetic locating signal in the form of at least one electromagnetic pulse.

7. The audio enhancing system according to claim 6, wherein said synchronization means comprises a position determination means for determining a position of said receiver means with respect to said primary signal propagating means, said position determination means calculating said position of said receiver means based on said at least one electromagnetic pulse.

8. The audio enhancing system according to claim 7, wherein said synchronization means selects one channel of said plurality of channels based on said position of said receiver means.

9. The audio enhancing system according to claim 1, wherein said synchronization means automatically delays said first electromagnetic signal based on a radial distance of said receiver means from said transmitting means.

10. The audio enhancing system according to claim 6, wherein said second transmitting means comprises two electromagnetic pulse transmitters, each transmitting said electromagnetic locating signal in the form of electromagnetic pulses at regular intervals, wherein a radial distance of said receiver means from said transmitting means is calculated based on said electromagnetic pulses.

11. The audio enhancing system according to claim 1, wherein both said receiver means and said synchronization means are positioned on a portable headset worn by a transient listener.

12. The audio enhancing system according to claim 1, wherein said second transmitting means comprises pulse transmitters positioned at discrete locations about said arena, and said synchronization means comprises a position determination and channel selection circuitry within said receiver means, said pulse transmitters transmitting said electromagnetic locating signal in the form of a plurality of electromagnetic pulses and said position determination and channel selection circuitry calculating a position of said receiver means based on said electromagnetic pulses and selecting said first electromagnetic signal based on said position.

* * * * *